US008668586B2

(12) United States Patent
Barclay et al.

(10) Patent No.: US 8,668,586 B2
(45) Date of Patent: Mar. 11, 2014

(54) CONTROLLING AND PRESENTING ONLINE WAGERING GAMES

(75) Inventors: Brian J. Barclay, Atlanta, GA (US); Daniel P. Louie, Chicago, IL (US); Scott H. Schulhof, Chicago, IL (US); Richard T. Schwartz, Chicago, IL (US)

(73) Assignee: WMS Gaming, Inc., Waukegan, IL (US)

( * ) Notice: Subject to any disclaimer, the term of this patent is extended or adjusted under 35 U.S.C. 154(b) by 0 days.

(21) Appl. No.: 13/125,231

(22) PCT Filed: Oct. 23, 2009

(86) PCT No.: PCT/US2009/061967

§ 371 (c)(1),
(2), (4) Date: Apr. 20, 2011

(87) PCT Pub. No.: WO2010/048591

PCT Pub. Date: Apr. 29, 2010

(65) Prior Publication Data

US 2011/0201414 A1 Aug. 18, 2011

Related U.S. Application Data

(60) Provisional application No. 61/108,120, filed on Oct. 24, 2008.

(51) Int. Cl.
*A63F 9/24* (2006.01)

(52) U.S. Cl.
USPC ..... 463/41

(58) Field of Classification Search
None
See application file for complete search history.

(56) References Cited

U.S. PATENT DOCUMENTS

| | | | | |
|---|---|---|---|---|
| 7,189,161 | B1 * | 3/2007 | Wiltshire et al. | 463/42 |
| 7,347,779 | B2 | 3/2008 | James-Herbert | |
| 7,468,728 | B2 | 12/2008 | Watt | |
| 7,677,970 | B2 * | 3/2010 | O'Kelley et al. | 463/25 |
| 7,849,043 | B2 * | 12/2010 | Woolf et al. | 706/48 |

(Continued)

FOREIGN PATENT DOCUMENTS

| | | |
|---|---|---|
| JP | 2008217142 | 9/2008 |
| JP | 2008250608 | 10/2008 |
| WO | WO2010048591 | 4/2010 |

OTHER PUBLICATIONS

"PCT Application No. PCT/US09/61967 International Preliminary Report on Patentability", Mar. 15, 2011 , 23 pages.

(Continued)

*Primary Examiner* — Paul A D'Agostino
(74) *Attorney, Agent, or Firm* — DeLizio Gilliam, PLLC

(57) ABSTRACT

A wagering game system and its operations are described herein. In embodiments, the operations can include receiving login information to log in to an online gaming venue and determining a player account associated with the login information. The operations can also include presenting the online gaming venue on a personal computing device associated with the player account. The online gaming venue can include casino related data that indicates ambience of a gambling environment (e.g., a casino, a poker room, etc.), interactive objects to interact with the player account, and communication functions to share recorded activity and other personal information, between the player account and other player accounts within the online gaming venue. In some embodiments, the operations can also include determining indications of player emotions and presenting multi-media files in conjunction with player avatars to represent the indicated emotions within the online gaming venue.

17 Claims, 8 Drawing Sheets

(56) References Cited

U.S. PATENT DOCUMENTS

| | | | | |
|---|---|---|---|---|
| 7,887,419 | B2 * | 2/2011 | Bortnik et al. | 463/42 |
| 8,145,676 | B2 * | 3/2012 | Bhogal et al. | 707/802 |
| 2001/0036864 | A1 * | 11/2001 | Melas | 463/42 |
| 2002/0175466 | A1 * | 11/2002 | Loose et al. | 273/143 R |
| 2005/0137015 | A1 * | 6/2005 | Rogers et al. | 463/42 |
| 2005/0239546 | A1 * | 10/2005 | Hedrick et al. | 463/29 |
| 2006/0025220 | A1 * | 2/2006 | Macauley et al. | 463/42 |
| 2006/0258463 | A1 * | 11/2006 | Cugno et al. | 463/42 |
| 2006/0281543 | A1 | 12/2006 | Sutton et al. | |
| 2006/0293103 | A1 * | 12/2006 | Mendelsohn | 463/42 |
| 2007/0093297 | A1 | 4/2007 | Moshal | |
| 2007/0093299 | A1 | 4/2007 | Bergeron et al. | |
| 2007/0113181 | A1 * | 5/2007 | Blattner et al. | 715/706 |
| 2007/0149288 | A1 * | 6/2007 | Nickell et al. | 463/42 |
| 2007/0149290 | A1 * | 6/2007 | Nickell et al. | 463/42 |
| 2007/0155509 | A1 * | 7/2007 | Wiltshire et al. | 463/42 |
| 2007/0218997 | A1 * | 9/2007 | Cho | 463/42 |
| 2008/0020814 | A1 | 1/2008 | Kernene | |
| 2008/0032800 | A1 * | 2/2008 | Liu et al. | 463/42 |
| 2008/0039165 | A1 * | 2/2008 | Harris et al. | 463/8 |
| 2008/0059570 | A1 * | 3/2008 | Bill | 709/203 |
| 2008/0153596 | A1 * | 6/2008 | Nguyen | 463/42 |
| 2008/0214287 | A1 * | 9/2008 | Lutnick et al. | 463/25 |
| 2008/0248849 | A1 * | 10/2008 | Lutnick et al. | 463/16 |
| 2008/0254881 | A1 * | 10/2008 | Lutnick et al. | 463/31 |
| 2008/0318687 | A1 * | 12/2008 | Backer et al. | 463/42 |
| 2009/0111576 | A1 * | 4/2009 | Ostergren et al. | 463/29 |
| 2009/0124349 | A1 * | 5/2009 | Dawson et al. | 463/24 |
| 2009/0163278 | A1 * | 6/2009 | Kawanaka et al. | 463/40 |
| 2009/0221367 | A1 * | 9/2009 | Longley et al. | 463/32 |
| 2011/0086699 | A1 * | 4/2011 | Allen et al. | 463/25 |

OTHER PUBLICATIONS

"PCT Application No. PCT/US09/61967 International Search Report", Mar. 3, 2010 , 9 pages.

* cited by examiner

CONTROLLING AND PRESENTING ONLINE WAGERING GAMES

RELATED APPLICATIONS

This application claims the priority benefit of U.S. Provisional Application Ser. No. 61/108,120 filed Oct. 24, 2008.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2009, WMS Gaming, Inc.

TECHNICAL FIELD

Embodiments of the inventive subject matter relate generally to wagering game systems and networks that, more particularly, control and present online wagering games.

BACKGROUND

Wagering game machines, such as slot machines, video poker machines and the like, have been a cornerstone of the gaming industry for several years. Traditionally, wagering game machines have been confined to physical buildings, like casinos (e.g., resort casinos, road-side casinos, etc.). The casinos are located in specific geographic locations that are authorized to present wagering games to casino patrons. However, with the proliferation of interest and use of the Internet, shrewd wagering game manufacturers have recognized that a global public network, such as the Internet, can reach to various locations of the world that have been authorized to present wagering games. Any individual with a personal computing device (e.g., a personal computer, a laptop, a personal digital assistant, a cell phone, etc.) can connect to the Internet and process wagering games. Consequently, some wagering game manufacturers have created wagering games that can be processed by personal computing devices and offered via online casino websites ("online casinos"). However, online casinos face challenges and struggles. For instance, online casinos have struggled to provide the excitement and entertainment that a real-world casino environment provides. Some online casinos have struggled enforcing cross jurisdictional restrictions and requirements. Further, some online casinos have struggled adapting the online gaming industry to a traditionally non-wagering game business environment. As a result, wagering game manufacturers, casino operators, and online game providers face growing pains and challenges in making the online gaming industry appealing and profitable.

SUMMARY

In some embodiments, a method comprises receiving login information to log in to an online gaming venue; determining a wagering game player account associated with the login information; presenting the online gaming venue, wherein the online gaming venue includes background data that indicates an ambience of a real-life gambling environment; presenting one or more interactive objects to interact with the wagering game player account; and communicating personal information between the wagering game player account and one or more additional player accounts within the online gaming venue.

In some embodiments, the method further comprises presenting a wagering game object representing a wagering game machine; determining a selection of the wagering game object; generating a virtual waiting list indicating a list of the one or more additional player accounts waiting to play a wagering game with the wagering game object; and placing a representation of the wagering game player account on the waiting list.

In some embodiments, the method further comprises determining a selection of an avatar for at least one other player account that is associated with one or more of the wagering game object and the virtual waiting list; and communicating information between the wagering game player account and the at least one other player account.

In some embodiments, the method further comprises simultaneously presenting one or more copies of an avatar for the wagering game player account on one or more of the waiting list and one or more additional waiting lists.

In some embodiments, the method further comprises presenting the wagering game on a display that originates from the wagering game object.

In some embodiments, communicating the personal information between the wagering game player account and the one or more additional player accounts comprises sharing files of recorded online casino activity between the wagering game player account and the one or more additional player accounts.

In some embodiments, an apparatus comprises means for presenting an access object for a private location within an online gaming venue; means for determining a selection of the access object by a wagering game player account logged in to the online gaming venue; means for determining a distinguishing element of the wagering game player account; and means for presenting one or more access options to the wagering game player account based on the distinguishing element, wherein the one or more access options include access abilities to the private location that correspond to a level of the distinguishing element.

In some embodiments, the apparatus further comprises means for determining that the level of the distinguishing element is insufficient to grant one of the one or more access options; means for redeeming an item of value from the wagering game player account; and means for granting the one of the one or more access options.

In some embodiments, the one or more access options include one or more of listening to private wagering game activity from outside the private location, entreating access to the private location, viewing one or more social contact accounts within the private location, communicating with the one or more social contact accounts within the private location, and accessing the private location.

In some embodiments, the apparatus further comprises granting the wagering game player account access to the private location; and providing the wagering game player account with additional access abilities that carry beyond the private location to other locations in the online gaming venue.

In some embodiments, the means for determining the distinguishing element of the wagering game player account comprises determining one or more of a value of a status for the wagering game player account, a value of social network points that the wagering game player account owns, and an award that the wagering game player account has received that indicates an increase to a player social status for a set amount of time.

In some embodiments, an apparatus comprises an online gaming module configured to present an online multi-media recorder, determine a selection to record online wagering game activity occurring in a portion of an online gaming venue, storing a recording of the online wagering game activity, present an option to share the video recording with a social contact account; determine a selection of the social contact account, and transfer a copy of the video recording to the social contact account.

In some embodiments, the apparatus further comprises receiving one or more comments from the social contact account; and annotating the video recording with the one or more comments.

In some embodiments, the online gaming module is further configured to present controls to customize the recording.

In some embodiments, the online gaming module is further configured to share one or more other multi-media files with the social contact account.

In some embodiments, one or more machine-readable media having instructions stored thereon, which when executed by a set of one or more processors causes the set of one or more processors to perform operations comprises presenting an online gaming venue to one or more wagering game player accounts; presenting one or more player objects within the online gaming venue, wherein the one or more player objects represents the one or more wagering game player accounts; determining an indication of an emotion for at least one of the one or more wagering game player accounts; determining a multi-media file associated with the at least one of the one or more wagering game player accounts, the multi-media file associated with the indication of the emotion; and presenting the multi-media file in association with the one or more player objects as a virtual representation of the indication of the emotion for the at least one of the one or more wagering game player accounts.

In some embodiments, said operation of determining the indication of the emotion for the at least one of the one or more wagering game player accounts comprises operations for reading from an emotion setting set by the at least one of the one or more wagering game player accounts.

In some embodiments, said operation of determining the indication of the emotion for the at least one of the one or more wagering game player accounts includes operations comprising: receiving biometric data from one or more biometric devices, the biometric data indicating recordings of physical expressions made by players associated with the at least one of the one or more wagering game player accounts; analyzing the recordings of the physical expressions for emotional indicators; and determining the indication of the emotion based on the emotional indicators.

In some embodiments, said operation of determining the indication of the emotion based on the emotional indicators comprises operations for referring to one or more settings by the wagering game player account that indicate how to interpret the emotional indicators.

In some embodiments, the multi-media file comprises one or more of a graphical skin for an avatar, a sound recording, a music file, a video file, and a voice recording for the wagering game player account.

In some embodiments, a system comprises a wagering game server including a content store to store online wagering game content including online gaming objects with interactive objects and one or more background objects to indicate ambience of a real-life gambling environment, and an object controller configured to control one or more of positions, movements, actions, and functions of the online gaming objects. The system can also include a computer comprising a processor configured to process the online casino content and present the interactive objects simultaneously with the background objects in a virtual casino environment, and a gaming control device controller configured to detect and control a gaming pad attached to the computer, wherein the gaming pad includes one or more of controls and biometric detection devices that a wagering game player account uses to indicate an expression of an emotion.

In some embodiments, the biometric devices comprise one or more of a web-cam to capture facial expressions, a heart-rate monitor, an eye pupil dilation detector, a motion sensor in a chair, a sound detector, and a speech recognition device.

In some embodiments, the gaming pad includes one or more of prop reels, prop game meters, a physical game lever, a button panel, a control panel, and a video projection device configured to project wagering game images onto prop gaming devices.

In some embodiments, the system further comprises an account server including player preferences settings configured to store settings associated with indicated emotions by a player account, wherein the settings are configured to correlate multi-media files with the expression of the emotion, and wherein the object controller is configured to present the multi-media files in conjunction with an avatar to indicate the expression of the emotion.

In some embodiments, the computer further comprises an online activity editor configured to incorporate with the multi-media files recorded activity from an online gaming venue.

BRIEF DESCRIPTION OF THE DRAWING(S)

Embodiments are illustrated in the Figures of the accompanying drawings in which.

DESCRIPTION OF ILLUSTRATIVE EMBODIMENTS

This description of the embodiments is divided into six sections. The first section provides an introduction to embodiments. The second section describes example operating environments while the third section describes example operations performed by some embodiments. The fourth section describes additional example embodiments while the fifth section describes additional example operating environments. The sixth section presents some general comments.

Introduction

This section provides an introduction to some embodiments.

Wagering games are expanding in popularity. Many wagering game enthusiasts are demanding greater access to wagering games and content related to wagering games. As stated previously, some wagering game companies have created online casinos that provide a way for wagering game enthusiasts to play wagering games online. Some online casinos provide various features, such as social networks. Social networks allow wagering game players ("players") to create user accounts with one or more unique identifiers that represent an online persona. One example of a unique identifier is an "avatar". Avatars are graphical, "cartoon-like" depictions of a social network persona. These online personas and associated avatars add to the fun of belonging to a social network. Many online casinos, however, present an unsatisfactory wagering game experience to players who enjoy a more true-to-life gaming experience. Some players avoid the artificial feel of online casinos, even online casinos with some social network features, in favor of the feel and atmosphere provided by a physical, or "brick-and-mortar", casino.

Figure 1:
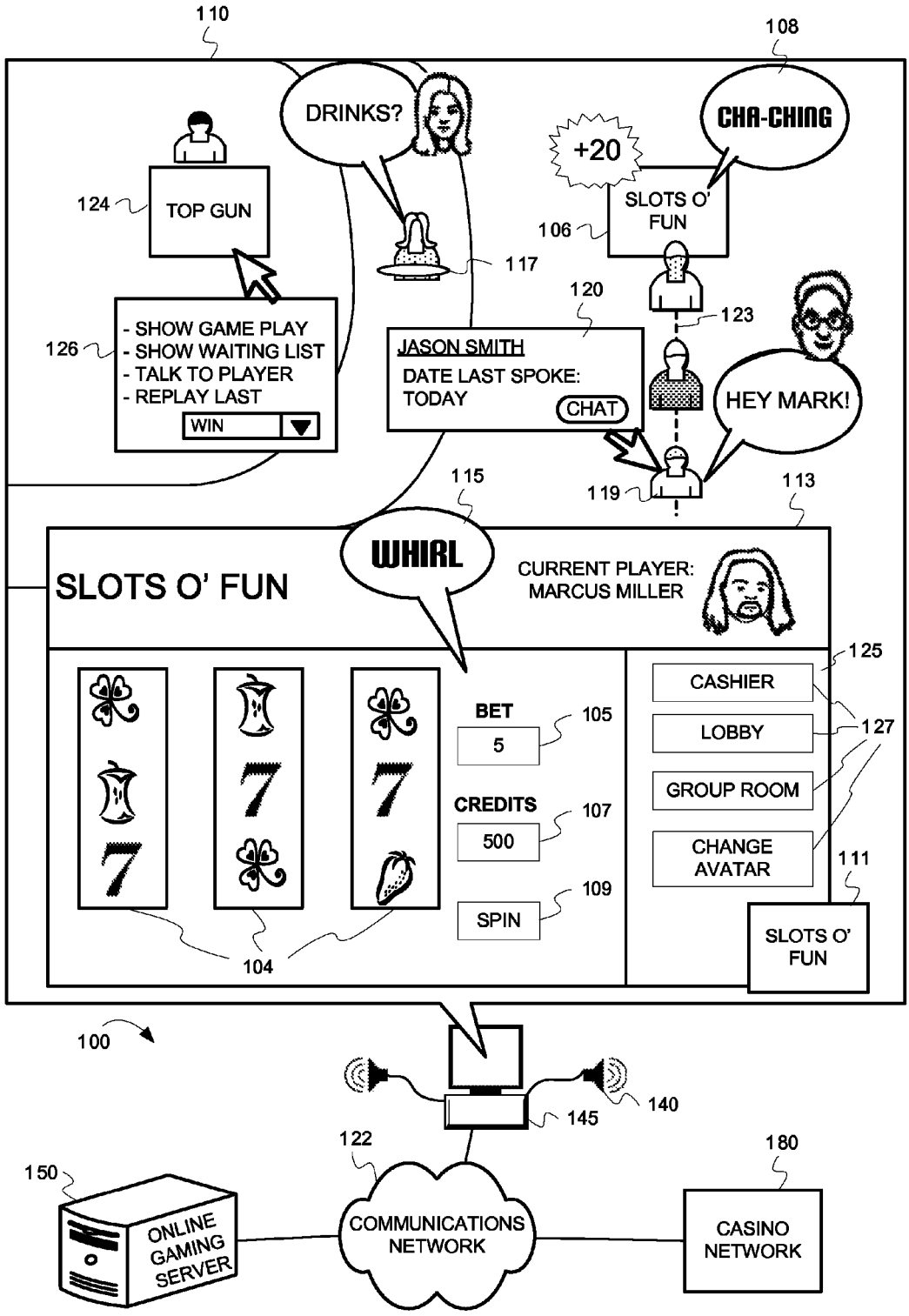
FIG. 1 is an illustration of presenting online gaming objects in an online gaming venue, according to some embodiments.

Some embodiments of the inventive subject matter, however, enable wagering game companies to provide the enjoyment and excitement derived from playing wagering games in a way that emulates a true-to-life gambling environment. Some embodiments incorporate social networks including ways for a player to communicate and share information via online gaming objects specifically configured to function with background information, gambling environment ambience, and customizable communication and presentation functionality. FIG. 1 shows an example wagering game system ("system") 100, configured with online gaming objects.

In some embodiments herein a player may be referred to interchangeably as a player account, or vice versa. Account-based wagering systems utilize player accounts when transacting and performing activities, at the computer level, that are initiated by players. Therefore a "player account" represents the player at a computerized level. The player account can perform actions via computerized instructions. For example, in some embodiments, a player account may be referred to as indicating an "emotion". Although a player, or person, may be activating a control to indicate the emotion, the player account, at the computer level, is associated with the player, and any associated devices that communicate the control activation to a processor, a server, or other device and/or initiates computerized instructions to perform the activation. Therefore, for brevity, to avoid having to describe the interconnection between player and player account in every instance, a "player account" is referred to herein in either context. Further, in some embodiments herein, the word "gaming" is used interchangeably with "gambling".

Figure 2:
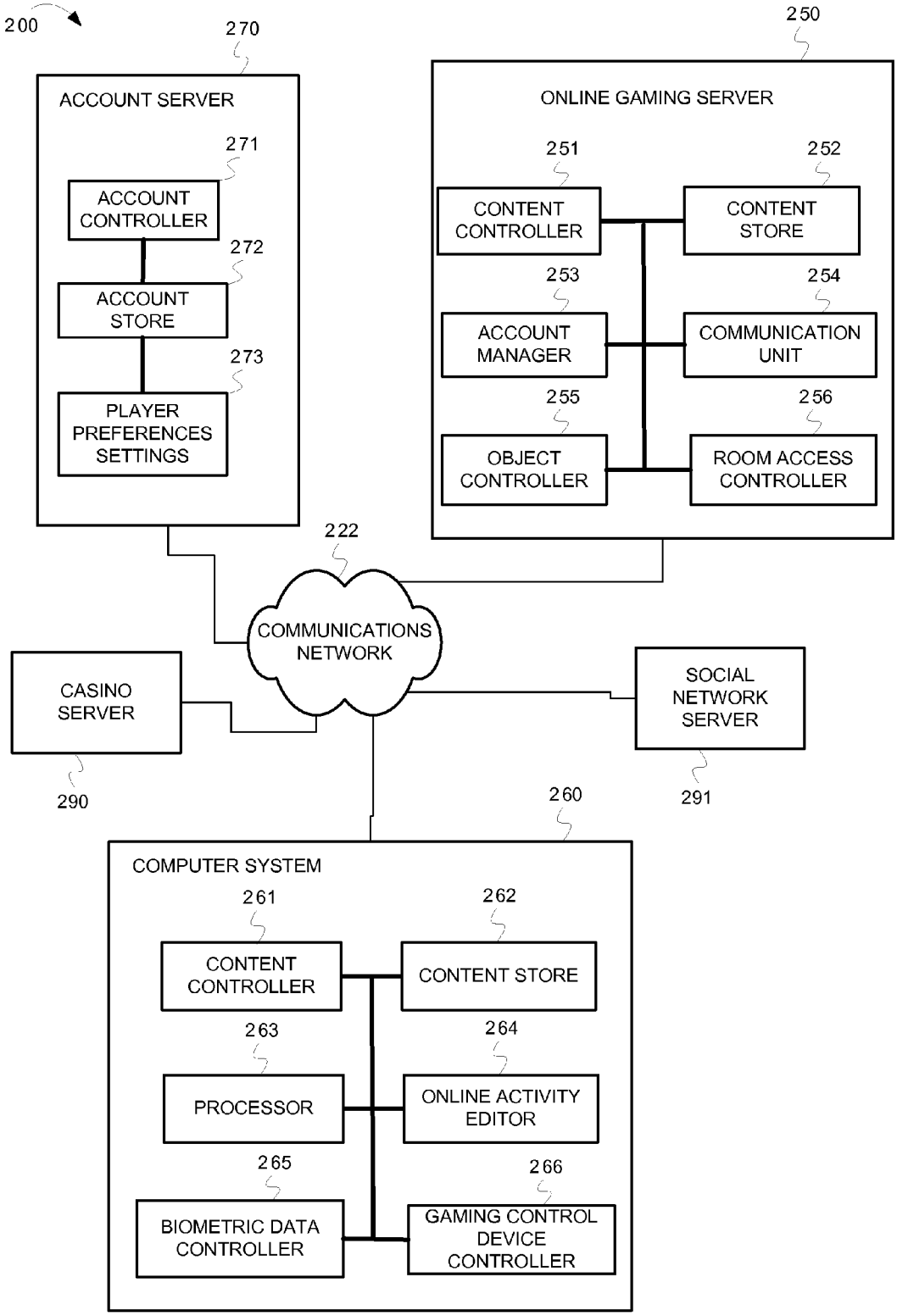
FIG. 2 is an illustration of a wagering game system architecture 200, according to some embodiments.
Figure 4:
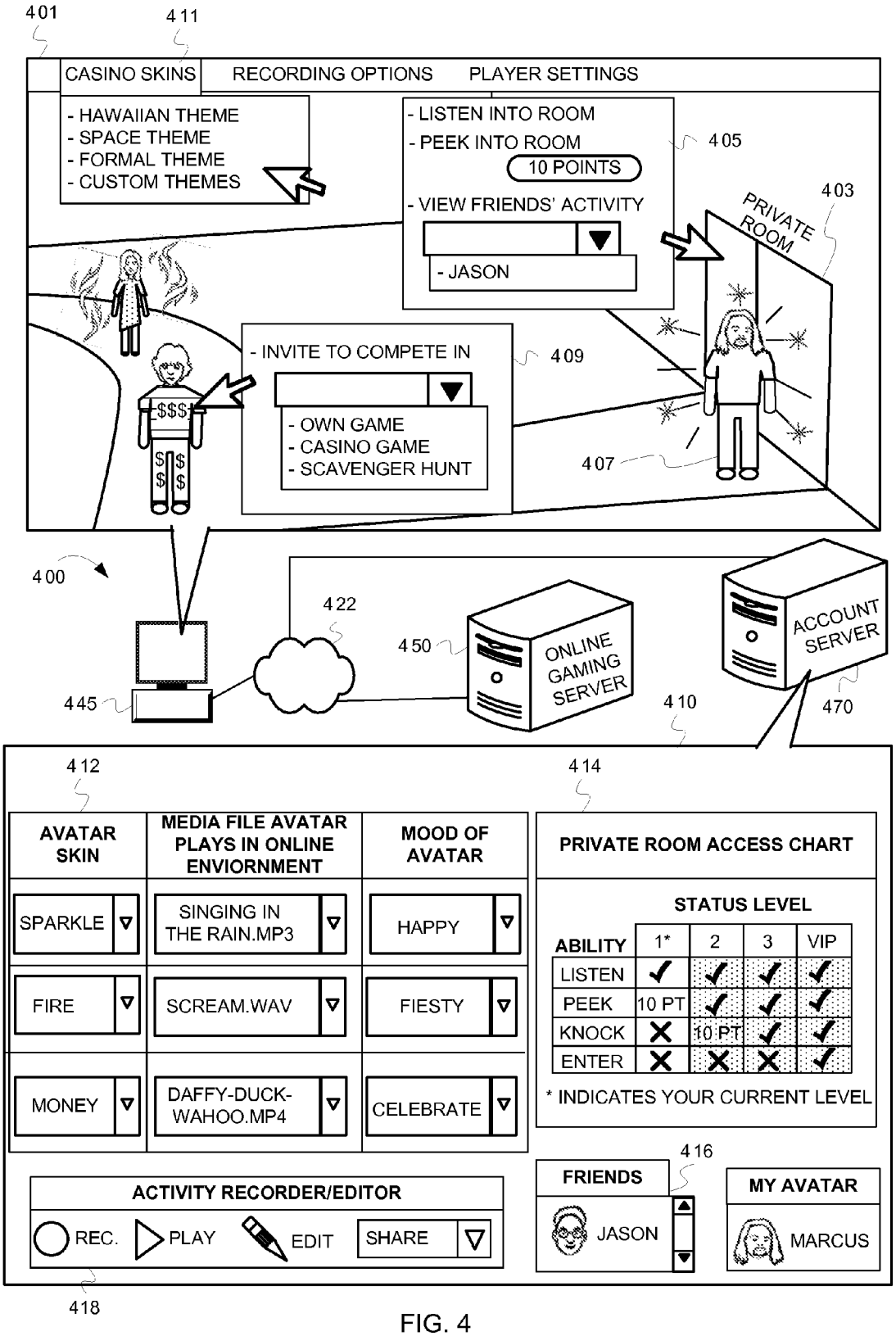
FIG. 4 is an illustration of a wagering game system 400, according to some embodiments.
Figure 6:
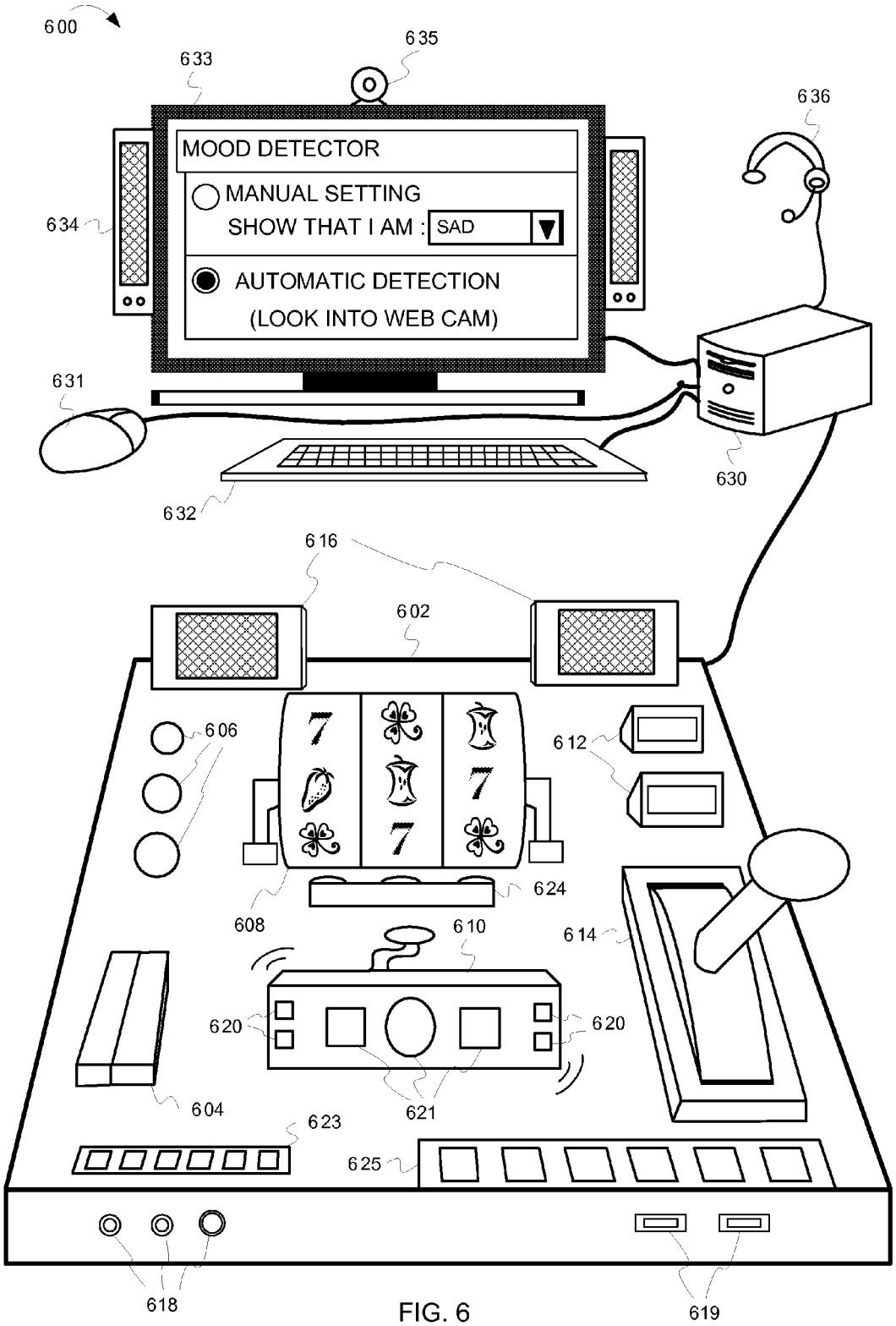
FIG. 6 is an illustration of a wagering game system 600, according to some embodiments.

FIG. 1 is a conceptual diagram that illustrates an example of presenting online gaming objects in an online gaming venue, according to some embodiments. In FIG. 1, the wagering game system ("system") 100 includes an online gamine server 150 connected to a client computer system ("computer system") 145 via a communications network 122. The online gaming server 150 can also be connected to a casino network 180, including one or more casino network devices associated with the casino network 180, such as wagering game servers, account servers, or other devices (not shown). The online gaming server 150 hosts an online gaming venue. FIG. 2 illustrates an example architecture of an online gaming server 250 according to some embodiments. The online gaming server 150 can provide one or more online gaming objects. The computer system 145 has a display 110 that can display the various online gaming objects. The online gaming objects represent items and people often seen and heard within a physical, "brick-and-mortar" casino. The online gaming objects, however, are representations in the form of computer objects that act and interact with player accounts that access the system 100 (e.g., via the computer system 145). The online gaming server 150 can present wagering game machine objects 106, 111, 124, which player accounts can use to play wagering games. For example, a controlling player account (e.g., player account owned by "Marcus Miller", logged in to the online gaming server 150 or another server associated with the online gaming server 150) can select the wagering game machine object 111. The system 100 presents the wagering game 113, with slot reels 104, a bet meter 105, a credit meter 107, and a spin control 109. The system 100 can also present controls to perform actions within the online gaming venue that are unique to a virtual environment. For example, the system 100 can include a player control panel 127 that includes control buttons 125 that can move the avatar and/or player's perspective instantaneously to various locations within the online gaming venue (e.g., to a lobby, to a cashier, to a private group room where group members congregate, etc.). The control buttons 125 can also change the appearance of the players account's avatar (e.g., change the avatar's clothes, change an avatar's emotional state as seen by other players, etc.). The system 100 can also present other wagering game machine objects 106, 124, which other player accounts may be playing and/or waiting to play (e.g., via a waiting list 123). In some embodiments the system 100 can present uniquely identifying images of specific games and game themes instead of, or in addition to, the wagering game machine objects 106, 127 (e.g., the system 100 may present a graphic of an attract screen for the wagering game, a symbol of a game character, etc.). The system 100 can present characters, either canned or associated with real user accounts, that traverse the regions of the online gaming venue, such as avatars associated with casino staff (e.g., a waitress avatar 117) or other player accounts (e.g., a social contact avatar 119 belonging to a social contact account of the controlling player account). The wagering game machine objects 106, 111, 124 and avatars 117, 119, can make sounds and present images that imitate the experience of being within a real-life casino. The system 100 can also present various controls, such as player communication controls 120 and wagering game machine object controls ("machine object controls") 126. The player communications controls 120 can present chat controls configured to initiate a chat session with a character (e.g., another player account) within the online gaming venue and/or to share items and information with the character. The machine object controls 126 can present options configured to view information about the wagering game object 124, such as peeking into the wagering game being played, viewing a waiting list, talking to a player account playing the game, replaying wins, losses, advertisements, or other information previously displayed. Many embodiments will be explained in further detail below in other Figures that refer back to FIG. 1. For example, FIG. 4 illustrates examples of controlling access to private rooms, conveying virtual representations of emotions on avatars, customizing a look and feel for the online gaming venue's layout, and controlling player preferences in a user account to express emotions, play and record online activity, share files, or control activities within the online gaming venue. In other examples, FIG. 6 illustrates an example wagering game pad that can connect to a computer system and immerse an online player into the online gaming experience.

Although FIG. 1 describes some embodiments, the following sections describe many other features and embodiments.

Example Operating Environments

This section describes example operating environments and networks and presents structural aspects of some embodiments. More specifically, this section includes discussion about wagering game system architectures.

Wagering Game System Architecture

FIG. 2 is a conceptual diagram that illustrates an example of a wagering game system architecture 200, according to some embodiments. The wagering game system architecture 200 can include an account server 270 configured to control user related accounts accessible via wagering game networks and social networks. The account server 270 can store and track player information, such as identifying information (e.g., avatars, screen name, account identification numbers, etc.) or other information like financial account information, social contact information, etc. The account server 270 can contain accounts for social contacts referenced by the player account. The account server 270 can also provide auditing capabilities, according to regulatory rules, and track the performance of players, machines, and servers. The account server 270 can include an account controller 271 configured to control information for a player's account. The account server 270 can also include an account store 272 configured to store information for a player's account. The account server 270 can also include a player preferences settings 273 configured to store settings associated with actions, skins, behaviors, multi-media files, music, and other information with a player account's indicated expressions of emotion, and/or a system imposed expression of an emotion, for an avatar or other object within the online gaming venue. The player preferences settings 273 can communicate information to an object controller 255 to apply the information stored in the settings to an avatar object associated with the player account.

The wagering game system architecture 200 can also include an online gaming server 250 configured to control wagering game content, provide random numbers, and communicate wagering game information, account information, and other information to and from a computer system 260. The online gaming server 250 can include a content controller 251 configured to manage and control content for the presentation of content on the computer system 260. For example, the content controller 251 can generate game results (e.g., win/loss values), including win amounts, for games played on the computer system 260. The content controller 251 can communicate the game results to the computer system 260. The content controller 251 can also generate random numbers and provide them to the computer system 260 so that the computer system 260 can generate game results. The online gaming server 250 can also include a content store 252 configured to contain content to present on the computer system 260. The online gaming server 250 can also include an account manager 253 configured to control information related to player accounts. For example, the content controller 251 can communicate wager amounts, game results amounts (e.g., win amounts), bonus game amounts, etc., to the account server 270. The online gaming server 250 can also include a communication unit 254 configured to communicate information to the computer system 260 and to communicate with other systems, devices and networks. For example, the communication unit 254 can track and communicate with community wagering game servers, account servers, community servers, social networking servers, file sharing servers, etc. The online gaming server 250 can also include the object controller 255 configured to control position, movements, actions, functions, etc. of online gaming objects. The online gaming server 250 can also include a room access controller 256 configured to control access to online gaming venue rooms, including security and access levels based on player settings, player status, etc.

The wagering game system architecture 200 can also include the computer system 260 configured to present wagering games and receive and transmit information to control and present online wagering games. The computer system 260 can include a content controller 261 configured to manage and control content and presentation of online gaming venue content on the computer system 260. The computer system 260 can also include a content store 262 configured to contain content to present on the computer system 260. The computer system 260 can also include a processor 263 configured to process wagering game content, present online wagering game objects, control gaming devices, etc. The computer system 260 can also include an online activity editor 264 configured to record, modify, and share recorded online gaming activity. The online activity editor 264 is further configured to add comments, text, pictures and other multi-media modifications to the recorded online gaming activity files. The online activity editor 264 can share the recorded online gaming activity with other player accounts. The computer system 260 can also include a biometric data controller 265 configured to detect biometric data from one or more sensors and equipment attached to the computer system and transfer the data to the object controller to express one or more indications of emotions by a player account. The computer system 260 can also include a gaming control device controller 266 configured to detect and control devices, including a gaming pad, custom player control devices, login devices, etc. The gaming pad, for example, can be configured to move an avatar within the online gaming venue in a very fluid motion, much more fluidly than possible with a standard keyboard.

The wagering game system architecture 200 can also include a casino server 290 configured to provide wagering game content and control information for wagering games. The wagering game system architecture 200 can also include a social network server 291 configured to provide social network content and social network account information.

Each component shown in the wagering game system architecture 200 is shown as a separate and distinct element connected via a communications network 222. However, some functions performed by one component could be performed by other components. For example, the online gaming server 250 can also be configured to gather and store biometric data, record and store online gaming activity, transfer shared files between player accounts, etc. Furthermore, the components shown may all be contained in one device, but some, or all, may be included in, or performed by multiple devices, as in the configurations shown in FIG. 2 or other configurations not shown. Furthermore, the wagering game system architecture 200 can be implemented as software, hardware, any combination thereof, or other forms of embodiments not listed. For example, any of the network components (e.g., the wagering game machines, servers, etc.) can include hardware and machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 3:
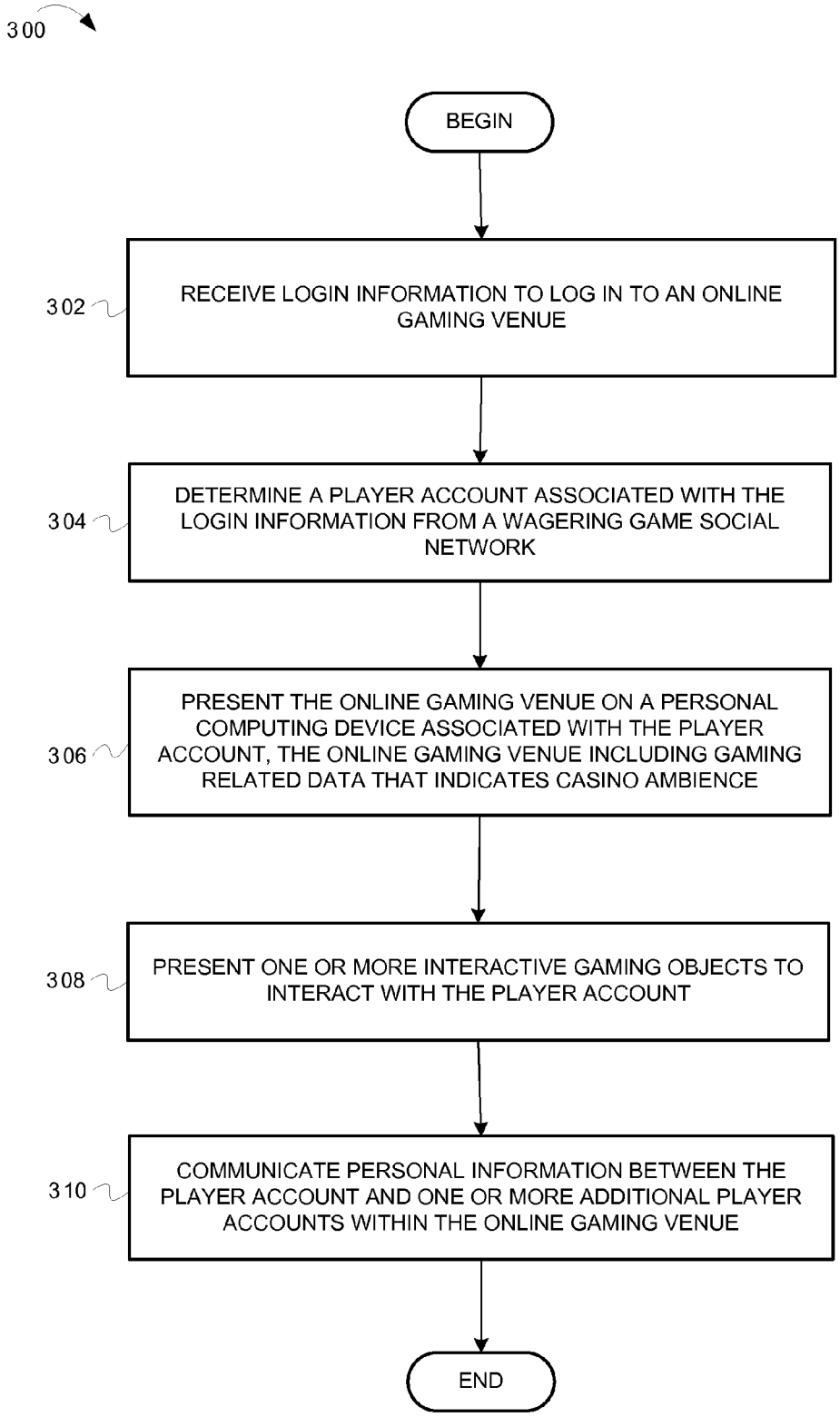
FIG. 3 is a flow diagram 300 illustrating controlling and presenting online gaming objects and player account interactivity, according to some embodiments.

FIG. 3 is a flow diagram ("flow") 300 illustrating controlling and presenting online gaming objects and player account interactivity, according to some embodiments. FIGS. 1 and 4 are conceptual diagrams that help illustrate the flow of FIG. 3, according to some embodiments. This description will present FIG. 3 in concert with FIGS. 1 and 4. In FIG. 3, the flow 300 begins at processing block 302, where a wagering game system ("system") receives login information to log in to an online gaming venue. The login information can be received from a client device (e.g., the computer system 145 in FIG. 1) that accesses an online gaming server (e.g., the online gaming server 150 in FIG. 1). The login information can include account names, passwords, and other account access information.

The flow 300 continues at processing block 304, where the system determines a player account associated with the login information from a wagering game social network. For example, the system can login to one or more servers (e.g., the online gaming server 150, the account server 270, the casino server 29, the social network server 291, etc.) that hold account information for a player account. The player account can be associated with a social network that integrates with the online gaming venue.

The flow 300 continues at processing block 306, where the system presents an online gaming venue on a personal computing device associated with the player account, the online gaming venue including data that indicates an ambience of a real-life gambling environment (e.g., a casino, a bar, a poker game, a bingo parlor, a sports betting arena, etc.). In some embodiments, the system can present background sounds that occur in a casino, background images that look like a casino, canned characters found in a casino (waitresses, pit bosses, playing characters, etc.), events and activities that transpire in a casino, etc. For example, in FIG. 1, the wagering game machine object 106 makes a sound 108 of winning money, credits, or some other award. The speakers 140 present the sound 108. Similarly, other objects within the online gaming venue can make noises, such as the slot machine object 111, which presents the machine game 113 that is being played by a logged in player account ("controlling player account"). The slot machine game 113 makes another sound 115, such as the sound of the slot reels 104 as they spin. The speakers 140 also present the sound 115. The system 100, however, can modify the sound 108 and/or sound 115 to indicate spatial or geographic distance of objects to the location of the player account within the online gaming venue. For instance, the system 100 can modify the sound 108 to be softer, or quieter, than the sound 115, so that the sound 108 sounds like a background sound. Characters can also make sounds and perform activities. For example, the waitress avatar 117 can provide drinks, perform valet tasks, and offer assistance, similar to in a physical casino. Friends, or other social contacts, such as the player object 119, can speak to the player account when the player account is within vocal range to be heard over ambient noise. Further, the system 100 can also push audio from certain locations in the online gaming venue and target the sounds at an avatar to entire the avatar to visit the location and/or perform an activity. For example, the system 100 can increase the volume of a distant audio sound from a room and focus it on some, or all, avatars near the room, to entice the avatars to come near to the room and explore the room. The system 100 can also present features for the player account that extend beyond a real-life abilities, such as presenting communication features that allow players to chat from across a room, peeking through closed doors, teleporting across large distances, changing appearances based on indications of emotions, finding locations (e.g., rooms) where there appears to be excitement (e.g., where many players are winning, where a majority of avatars are reflecting happy emotions, etc.), and so forth. Many of these features are described further below. In some embodiments, the system can present the online gaming venue from the player account's perspective, or other perspectives (e.g., eye-in-the-sky, eye-level, zoom, pan, etc.).

The flow 300 continues at processing block 308, where the system presents one or more interactive objects to interact with the player account. In some embodiments, the system can present a wagering game object representing a wagering game machine ("wagering game machine object"). The system can also determine a selection of the wagering game machine object and present an option for a virtual waiting list indicating a list of player accounts waiting to play a wagering game with the wagering game machine object. For instance, in FIG. 1, the wagering game machine object 106 includes the waiting list 123 with multiple player objects waiting in line to play a game on the wagering game machine object 106. The player objects can be clones, or copies, of an avatar image associated with a player account, so that a player account can wait in more than one waiting list simultaneously. The system 100 can provide the wagering game machine object control ("machine object control") 126 that appears when a player account selects the wagering game machine object 124. One of the options on the machine object control 126 includes an option showing the waiting list. The system 100 can then present other options, and activate the options when selected, for placing the player account on the waiting list, for removing the player account from the playing list, or other actions associated with the waiting list. In some embodiments, the system 100 can present an option to speak with a player that is playing the wagering game object or that is waiting in the waiting list. In some embodiments, the system 100 can present an option to view a wagering game currently being played on the wagering game machine object 124 as well as past activity (e.g., past game played) on the wagering game machine object 124. In some embodiments, the system 100 can present one or more copies or clones of avatars waiting in one or more lines (e.g., multiple lines) for the wagering game. In some embodiments, the system 100 can present an access object for a private location within the online gaming venue. In some embodiments, the private location can be a room in the online gaming venue that is off limits to player accounts, unless the player account has authority to access the room. The room can be based on game types, activities, etc. For example, some rooms may register a player account for a progressive game. The player account may leave the room, but may still be eligible for the progressive. In some embodiments, the room, or other location in the online gaming venue, may allow player accounts to pull some gaming objects, concepts, themes, etc., from the room and create a private room hosted by the player account. The system100 can also link the games in the private rooms to a progressive, a community game, or any other group game type. In some embodiments, the room can be public for all to enter, at some times, but also can be reserved or made private, at other times (e.g., reserved for special occasions, events, tournaments, etc.). FIG. 4 illustrates some examples of a private online gaming venue room 403. In FIG. 4, a wagering game system ("system") 400 includes a computer system 445 connected to an online gaming server 450 and an account server 470 via a communications network 422. The computer system 445 has a display 401 that shows an example access object ("door") 403 that provides access to a private room. The system 400 can prevent access of player accounts to the private room by preventing access through the door 403. The system 100 can present access controls 405 that appear when the door 403 is selected (e.g., when a player account clicks on the door 403 with a mouse pointer, when an avatar 407 that represents the controlling player account touches the door 403, etc.). The system 400 can also determine a social status level of the player account on the wagering game social network. The system 400 can determine a distinguishing element of the player account that distinguishes the player account from other player accounts. For example, the distinguishing element can be a social status for the wagering game player account. The system 400 can determine the social status level by determining a value of one or more points, awards, status, etc. that the player account owns. The points can be set on a scale where the player account may earn the points to obtain social status levels (e.g., based on point grades or plateaus) within a social network. The system 400 can also award, or determine that the player has been awarded, a specific social status level for a timed period, which increases the player account's social status for a set amount of time without necessarily increasing the social network point amount value. The access controls 405 can indicate a social status level obtained by the controlling player account. The access controls 405 can read from the account server 470 that indicates an account settings interface ("interface") 410. The interface 410 can include a private room access settings ("access settings") 414. The access settings 414 indicate abilities that the controlling player account possesses concerning private locations within the online gaming venue. The access settings 414 can indicate access levels based on the controlling player account's current status level, which may be based on a total number of accumulated status points. For instance, for a status level of "1", the player account can listen to activities occurring within the private room (e.g., listen through the door 403), but cannot perform other access related activities, such as peeking into the room momentarily, knocking on the door 403 to entreat access, or entering the room uninvited. Other status levels, however, may permit some of those, or other, access related abilities based on the status level. In some embodiments, the system 400 can provide access abilities if the player account performs additional activities (e.g., listens to an advertisement, registers for a number of slot tournaments, etc.) and/or provides some form of access compensation (e.g., paying some amount of entertainment points). The system can also present access options, within the access controls 405, to the player account based on the social status. The one or more access options include access ability levels that correspond with the social status levels indicated in the player account. In some embodiments, the system 400 can determine that the player social status is insufficient to grant an access option. The system can, therefore, present an option to redeem social network points to receive the access option. In some embodiments, the system can present a Very Important Person (VIP), or "high-limit" room, where a VIP status player account has additional abilities or powers to access the room and/or obtains abilities and powers in the room that carry beyond the room to the rest of the online gaming venue. In some embodiments, the system 400 can also present options to communicate or view activity of social contacts within a private room. For example, the access controls 405 can indicate a list of friends, or social contacts 416, that belong to the controlling player account. One or more of the social contacts 416 may have gained access to the private room. Consequently, the controlling player account, which may not have access to the room, can still communicate with, and/or view activities of, social contacts that are within the room using the access controls 405 (e.g., use the access controls 405 to show actions of friends' avatars using video or still images, provide chat controls to call the friends to the door 403, present live ticker feeds of friends' activities, etc.).

The flow 300 continues at processing block 310, where the system communicates personal information between the player account and one or more additional player accounts within the online gaming venue. In some embodiments, the system can present a player object within the online gaming venue, determine a selection of the player object, and present one or more options to converse with the other player object. For example, in FIG. 1, the system 100 can provide the player communication controls 120 for the player object 119. A player account can click on the player object 119 and use the player communication controls 120 to initiate a conversation, invite the player to perform an activity, etc. For example, in FIG. 4 the system 400 includes an invitation control 409 that a player account can use to invite other player accounts to play in group wagering games, custom designed games, etc. In some embodiments, the system 400 can present other features for communicating between player accounts, such as an online multi-media recorder. In FIG. 4, the interface 410 presents an online activity recorder ("recorder") 418. The recorder 418 can record wagering game activity occurring on a specific section of the online gaming venue. For instance, the controlling player account can select a location in the online gaming venue and beginning recording activity there. The player can leave the location, but the recorder can continue recording activity in that location. The system 400 can store a recording of the online wagering game activity and present the recording. The system 400 can provide controls to customize and edit the recording (e.g., controls to annotate the recording with text, sound or visual information, controls to crop, cut, slow, rewind, fast-forward, etc.). The system 400 can also present an option to share the video recording with a social contact account. In FIG. 4, the recorder 418 can include sharing controls that the player account can use to select other player accounts and send them recordings. The system can also determine a selection of the social contact account and transfer a copy of the video recording to the social contact account (e.g., transfer via an account server, email, etc.). In some embodiments, the system 400 can include settings that automatically begin recording activity, or stop recording activity, based on specific casino events. Those events may include celebratory events where if a player wins a jackpot the system 400 records the celebration of the win. The system 400 may also record activities and events in the background. The system 400 can append the recordings of the background activity to the player account's recording of activity. For instance, the player account may include a setting to record the jackpot win, but may not have recorded the games before the jackpot win that lead up to the win. The system 400, therefore, can record the events of the entire wagering game session in anticipation of the player account needing information to append to the player account's own recordings. If the condition is not met during the wagering game session (e.g., no jackpot win), or for another pre-set duration of time, the system 400 can delete the background recordings. The player account can add other items to the recording, such as photographs, text, comments, titles, sound, etc. to generate a multi-media presentation.

Figure 5:
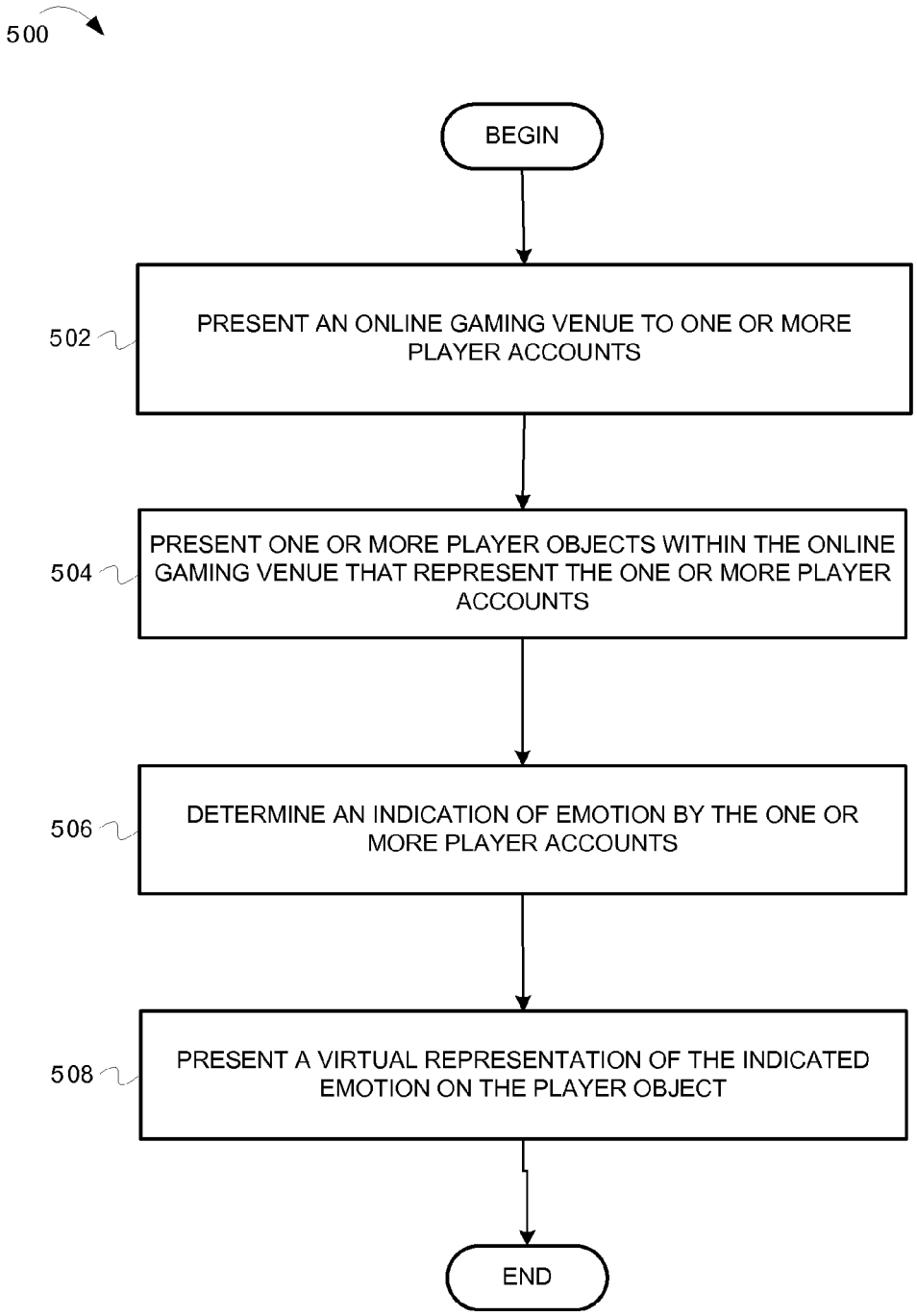
FIG. 5 is a flow diagram 500 illustrating presenting virtual representations of indications of emotions on online casino player objects, according to some embodiments.

FIG. 5 is a flow diagram ("flow") 500 illustrating presenting virtual representations of indications of emotions on online player objects, according to some embodiments. FIG. 4 and FIG. 6 are conceptual diagrams that help illustrate the flow of FIG. 5, according to some embodiments. This description will present FIG. 5 in concert with FIGS. 4 and 6. In FIG. 5, the flow 500 begins at processing block 502, where a wagering game system ("system") presents an online gaming venue to one or more player accounts. FIG. 4 illustrates an example virtual, 3-dimentional (3-D) environment of an online gaming venue, which the computer system 445 processes and renders in the display 401.

The flow 500 continues at processing block 504, where the system presents one or more player objects within the online gaming venue that represent the one or more player accounts. FIG. 4 illustrates an example of player objects as 3D avatars. FIG. 1 illustrates examples of two-dimensional (2D) avatars, or other player objects that represent the player accounts.

The flow 500 continues at processing block 506, where the system determines an indication of emotion by the one or more player accounts. In some embodiments, the system can capture biometric data from one or more biometric devices (e.g., web-cams to capture facial expressions, heart-rate monitors, eye pupil dilation detectors, motions sensors in a chair, sound detectors, speech recognition detectors, etc.). FIG. 6 illustrates example embodiments of a computer system 630 with biometric devices, and other devices, that can communicate, move, interact, and perform other activities within an online gaming venue. In FIG. 6, a wagering game system ("system") 600 includes the computer system 630 connected to several devices, including user input devices (e.g., a keyboard 632, a mouse 631), a web-cam 635, a monitor 633, speakers 634, and a headset 636 that includes a microphone and a listening device. In some embodiments, the webcam 635 can detect fine details of a person's facial features, from an eye-level perspective. The web-cam 635 can use the fine detail to determine a person's identity, their demeanor, their facial expressions, their mood, their activities, their eye focus, etc. The headset 636 can include biometric sensors configured to detect voice patterns, spoken languages, spoken commands, etc. The biometric sensors in the web-cam 635 can detect colors (e.g., skin colors, eye colors, hair colors, clothing colors, etc.) and textures (e.g., clothing material, scars, etc.). The biometric sensors in the web-cam 635 can also measure distances between facial features (e.g., distance between eyes, distance from eyes to nose, distance from nose to lips, length of lips, etc.). The system 600 can generate a facial and body map using the detected colors, textures, and facial measurements. The system 600 can use the facial and body map to generate similar facial features and body appearances for a player account avatar. Also connected to the computer system 630 is a gaming control device ("gaming pad") 602 including wagering game accoutrements associated with wagering games. The wagering game accoutrements include one or more of prop reels 608, prop game meters 612, indicators 606, a game control device 610, a physical lever 614, a magnetic card reader 604, a video projection device 624, input/output ports 618, USB ports 619, and speakers 616. The gaming pad 602 can present feedback of online activities. For instance, the gaming pad 602 can use vibrations and signals on the gaming control device (e.g., the game control device 610 or the physical level 614 can vibrate to indicate a back pat from another player or a game celebration, the indicators 606 can blink, etc.). The physical lever 614 can produce feelings in the lever to emulate a pulling feel or a vibration. The video projection device 624 can project video onto the props reels 608 so that the prop reels 608 can present many different types of wagering games. The prop reels 608 can spin when the physical lever 614 is pulled. The video projection device 624 can project reel icons onto the prop reels 608 as they spin. The video projection device 624 can also project reel icons onto the prop reels 608 when the prop reels 608 are stations, but the imagery from the video project device 624 makes the prop reels 608 appear to spin. The magnetic card reader 604 can be used to swipe a credit card, a player card, or other cards, so that the system can quickly get information. The system 600 can offer lower rates for using the magnetic card reader 604 (e.g., to get a lower rate per transaction). The game control device 610 can include an emotion indicator keypad with keys 620 that a player can use to indicate emotions. The game control device 610 can also include biometric devices 621 such as a heart-rate monitor, an eye pupil dilation detector, a fingerprint scanner, a retinal scanner, voice detectors, speech recognition microphones, motion sensors, sound detectors, etc. The biometric devices 621 can be located in other places, such as in the headset 636, within a chair (not shown), within personal control devices (e.g. joysticks, remote controls, game pads, roller-balls, touch-pads, touch-screens, etc.), within the web-cam 635, or any other external device. The external devices can be connected to the computer 630 or to the game control device 610 via the input/output ports 618. As a security feature, some biometric devices can be associated with some of the gaming pad devices (e.g., the magnetic card reader 604), such as a fingerprint scanner, a retinal scanner, a signature pad to recognize a player's signature, etc. The game control device 610 can also use the keys 620 to share items and control avatars, icons, game activity, movement, etc. within the online gaming venue. The game pad can also have an electronic (e.g., digital) button panel 625, an electronic control panel 623, or any other type of changeable panel that can change appearance and/or configuration based on the game being played, the action being performed, and/or other activity presented within an online gaming venue. The game control device 610 can also move in different directions to control activity within the online gaming venue (e.g., movement of a player's avatar moves in response to the movements of the game control device 610). Avatars can be pre-programmed to act and look in certain ways, which the player can control using the system 600. The gaming pad 602 can permit the player to move the avatar fluidly and more easily than is possible using a standard keyboard. The system 600 can cause an avatar to respond to input that a player receives via the gaming pad 602. For example, a player may hear a sound that comes primarily from one direction (e.g., via stereophonic signals in the headset 636) within the online gaming venue. The system 600 can detect the movement of the player (e.g., the system 600 detects that a player moves his head to look in the direction of the sound, the player uses the game control device 610 to move the avatar's perspective to the direction of the sound, etc.). The system 600 can consequently move the avatar's head and/or the avatar's perspective in response to the player's movement. The player can indicate an expression of an emotion indicated by the player using the keys 620. The system 600 can make the avatar's appearance change to reflect the indicated emotion. The system 600 can respond to other movements or actions by the player and fluidly move the avatar to respond. The system 600 can interpret data provided by the biometric devices and determine expressions and/or indications of emotions for a player using the system 600. For example, the system 600, using the biometric devices, can record indications of emotional activity that the player exhibits. The system 600 can analyze data from the recorded indications of emotional activity for emotional indicators (e.g., a frown, a fast tapping foot, a smile, a shout) and matches those emotional indicators with descriptions of emotions generally characterized by those emotional indicators (e.g., a frown indicates a sad emotion, a smile indicates a happy emotion, a fast tapping foot indicates a nervous emotion, a shout indicates a celebratory emotion, etc.). In some embodiments, the player can use the mouse 631, the keyboard 632, the game control device 610, and/or other control devices, to indicate emotions, set settings (e.g., such as settings 412, 414), utilize the casino activity recorders 418, or perform other actions In some embodiments, the system can determine an emotion based on the biometric data and refer to one or more settings that the player account has set that indicate how to interpret the biometric data (e.g., a player has a setting that when the web-cam 635 detects a frown coupled with a specific hand signal, the setting equates that combination of movements as a "tired" emotion). In some embodiments, such as in FIG. 4, the system 400 can present a virtual representation of the indicated emotions for player accounts on the player objects (e.g., the 3D avatars) within the online gaming venue. For example, the system 400 can present a graphical skin that indicates expressions of emotions. The system 400 can determine emotion settings 412. The emotion settings 412 indicate skins and multi-media files that play within the online gaming venue when the system 400 determines indications of emotions of players associated with the controlling player account. For example, the emotion settings 412 can indicate preferences that the controlling player account sets. The player account can select personal sound files, movie files, music files, skin texture files, animation files, etc. and associate them, using the emotion settings 412, with emotion descriptions indicated in the emotion settings 412. In some embodiments, the system 400 can read information from files to determine emotion descriptions and virtual expressions of emotions indicated with them. For example, the system 400 can provide tagging controls to tag personal files with emotion indicators tags, instead of, and/or in addition to, using the emotion settings 412. The system 400 can search for the personal files using the emotion indicator tags and present them in association with a player account's avatar. In some embodiments, the system 400 can assign avatar sounds, emoticons, facial features, movements, or other activities to perform, based on detected and/or indicated emotions.

The flow 500 continues at processing block 508, where the system presents a virtual representation of the indicated emotion on the player object. In some embodiments, the system can present a graphical skin that indicates the expression of the emotion. The system can also determine one or more settings for the player account that indicate a graphical skin associated with the expression of the indicated emotion. In some embodiments, the system can determine a multi-media file associated with the player account that the player account has associated with the expression of the indicated emotion. The system can also present the multi-media file when the expression of the emotion is detected and/or indicated. In some embodiments, the system can record a player's voice associated with the player account and associate the voice with the avatar. The system can include a streamed, VoIP file of the person's real voice, in real time (or recorded), that is captured via a microphone (e.g., Skype).

Further, the system can determine and impose an expression of emotions on player objects based on player performance or situational activities. For example, if a player performed poorly on wagering games over a period of time, the system may cause a player object (e.g., an avatar) to look sad or grumpy even though the player may not actually be sad or grumpy.

Additional Example Embodiments

According to some embodiments, a wagering game system ("system") can provide various example devices, operations, etc., to control and present online wagering games. The following non-exhaustive list enumerates some possible embodiments.

- In some embodiments, the system can present a virtual reality online gaming venue (similar to the environment in the display 401 in FIG. 4), where a player can rotate the view (e.g., of a perspective, of an avatar, etc.) within the computer (e.g., pan a player's head), so the player can see. The system can also include 3-dimensional (3D) audio to enhance the sound of what a player's head is looking at. In some embodiments, however, the system can present 2-dimensional (2D) and 3D online gaming venues that don't utilize avatars. Player account can navigate through the online gaming venue using navigable frames, drop-down menus, etc.
- In some embodiments, the system can intentionally make items look grainy, or produce a simulated environment, to add realism (e.g., present a smoky or hazy look to a poker room).
- In some embodiments, the system can have templates of casino layouts, landmarks, etc. as skins (see FIG. 4 for example embodiments of a casino skins setting 411 that can select from different templates to change the appearance of the online gaming venue). The system can also provide controls and settings for player accounts to create their own casinos, games, rooms, sounds, etc.
- In some embodiments, the system can provide audio cues that are triggered by an activity. This alerts players (whether online or not), of the activity.
- In some embodiments, the system can present a news feed widget that constantly give updates of activity that occurs within the online gaming venue. A player account can subscribe to events that the news feed can give. The widget can send information to a cell phone, or other personal device, to notify a player of activities when the player is not logged on to the website and/or saved for later deliver when the player is available. Based on the information given in the news feed, the system can cause actions to occur (e.g., swap games, send comments, begin recording activity, etc.).
- In some embodiments, the system can use various windows, frames, toolbars, widgets, etc. on a web browser. The system can also integrate with desktop applications. The system can show multiple activities at once using one or more parts of the browser or application (e.g., present a split screen view showing different simultaneous wins or other activities).

Additional Example Operating Environments

This section describes example operating environments, systems and networks, and presents structural aspects of some embodiments.

Wagering Game Machine Architecture

Figure 7:
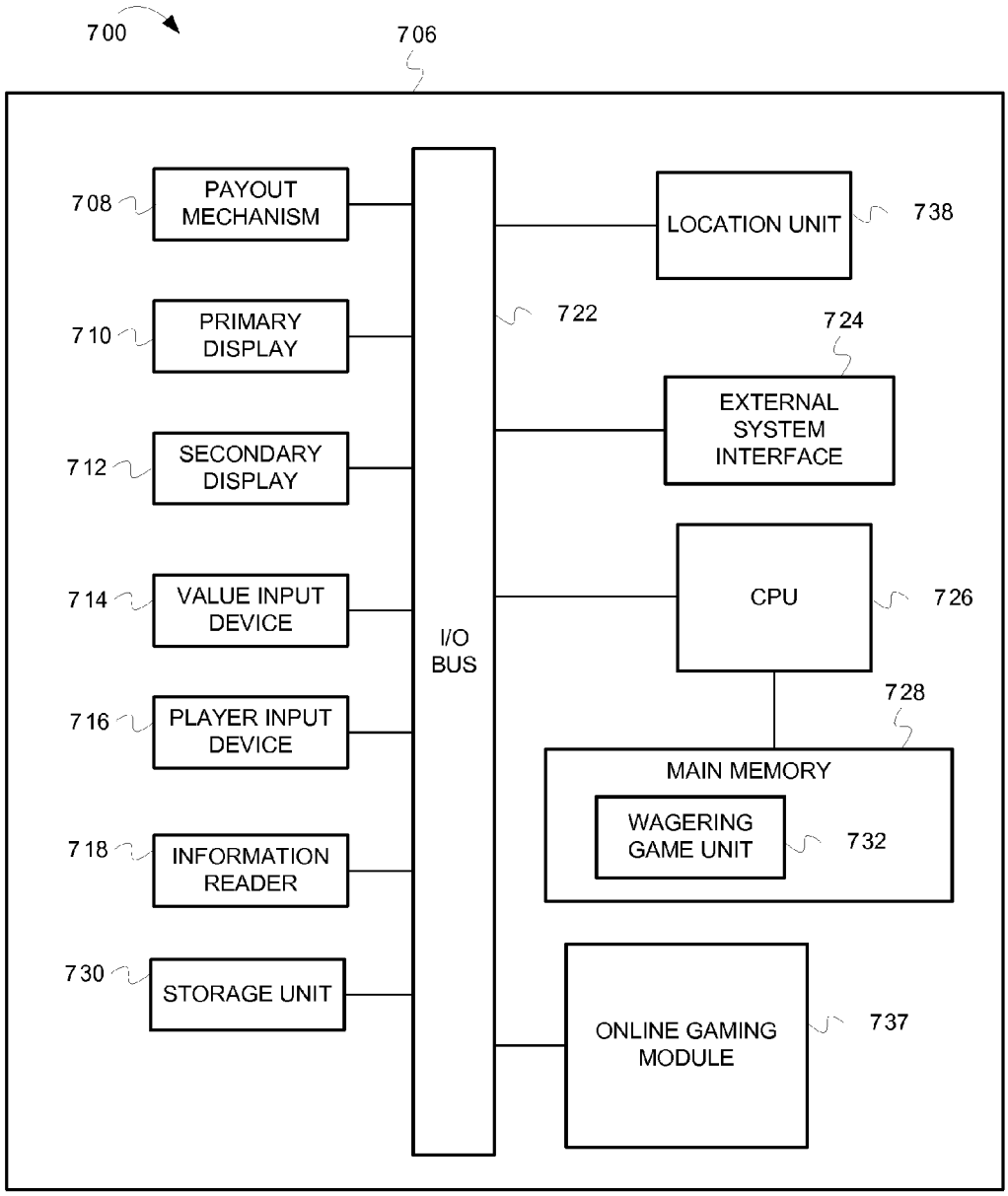
FIG. 7 is an illustration of a wagering game machine architecture 700, according to some embodiments.

FIG. 7 is a conceptual diagram that illustrates an example of a wagering game machine architecture 700, according to some embodiments. In FIG. 7, the wagering game machine architecture 700 includes a wagering game machine 706, which includes a central processing unit (CPU) 726 connected to main memory 728. The CPU 726 can include any suitable processor, such as an Intel® Pentium processor, Intel® Core 2 Duo processor, AMD Opteron™ processor, or UltraSPARC processor. The main memory 728 includes a wagering game unit 732. In some embodiments, the wagering game unit 732 can present wagering games, such as video poker, video black jack, video slots, video lottery, reel slots, etc., in whole or part.

The CPU 726 is also connected to an input/output ("I/O") bus 722, which can include any suitable bus technologies, such as an AGTL+ frontside bus and a PCI backside bus. The I/O bus 722 is connected to a payout mechanism 708, primary display 710, secondary display 712, value input device 714, player input device 716, information reader 718, and storage unit 730. The player input device 716 can include the value input device 714 to the extent the player input device 716 is used to place wagers. The I/O bus 722 is also connected to an external system interface 724, which is connected to external systems (e.g., wagering game networks). The external system interface 724 can include logic for exchanging information over wired and wireless networks (e.g., 802.11g transceiver, Bluetooth transceiver, Ethernet transceiver, etc.)

The I/O bus 722 is also connected to a location unit 738. The location unit 738 can create player information that indicates the wagering game machine's location/movements in a casino. In some embodiments, the location unit 738 includes a global positioning system (GPS) receiver that can determine the wagering game machine's location using GPS satellites. In other embodiments, the location unit 738 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 7, in some embodiments, the location unit 738 is not connected to the I/O bus 722.

In some embodiments, the wagering game machine 706 can include additional peripheral devices and/or more than one of each component shown in FIG. 7. For example, in some embodiments, the wagering game machine 706 can include multiple external system interfaces 724 and/or multiple CPUs 726. In some embodiments, any of the components can be integrated or subdivided.

In some embodiments, the wagering game machine 706 includes an online gaming module 737. The online gaming module 737 can process communications, commands, or other information, where the processing can control and present online wagering games.

Furthermore, any component of the wagering game machine 706 can include hardware, firmware, and/or machine-readable media including instructions for performing the operations described herein.

Mobile Wagering Game Machine

Figure 8:
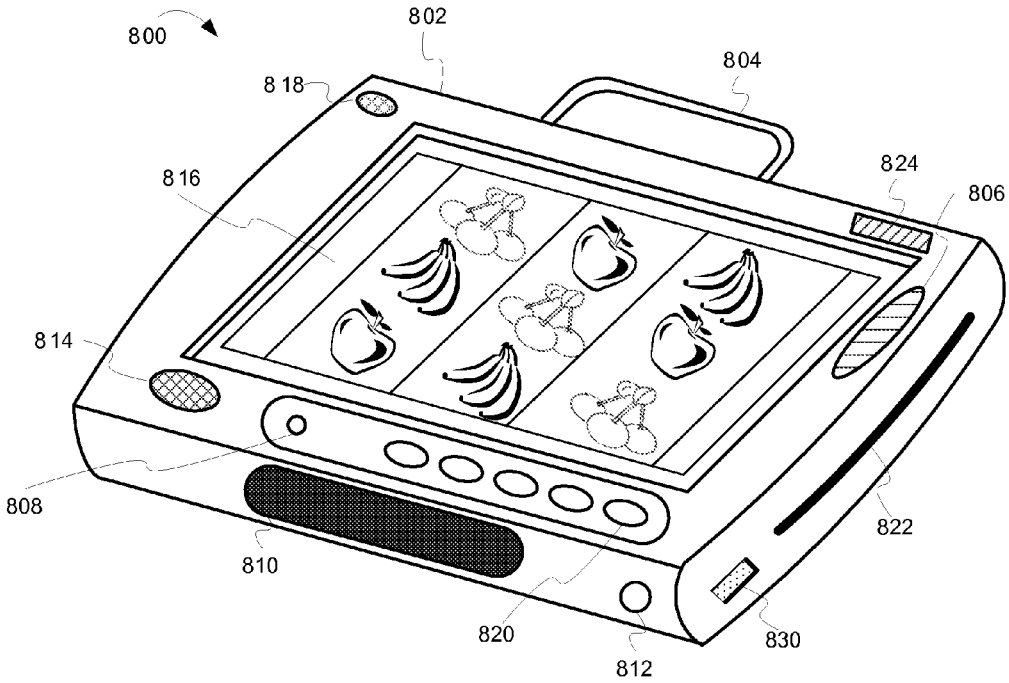
FIG. 8 is an illustration of a mobile wagering game machine 800, according to some embodiments.

FIG. 8 is a conceptual diagram that illustrates an example of a mobile wagering game machine 800, according to some embodiments. In FIG. 8, the mobile wagering game machine 800 includes a housing 802 for containing internal hardware and/or software such as that described above vis-à-vis FIG. 7. In some embodiments, the housing has a form factor similar to a tablet PC, while other embodiments have different form factors. For example, the mobile wagering game machine 800 can exhibit smaller form factors, similar to those associated with personal digital assistants. In some embodiments, a handle 804 is attached to the housing 802. Additionally, the housing can store a foldout stand 810, which can hold the mobile wagering game machine 800 upright or semi-upright on a table or other flat surface.

The mobile wagering game machine 800 includes several input/output devices. In particular, the mobile wagering game machine 800 includes buttons 820, audio jack 808, speaker 814, display 816, biometric device 806, wireless transmission devices (e.g., wireless communication units 812 and 824), microphone 818, and card reader 822. Additionally, the mobile wagering game machine can include tilt, orientation, ambient light, or other environmental sensors.

In some embodiments, the mobile wagering game machine 800 uses the biometric device 806 for authenticating players, whereas it uses the display 816 and speakers 814 for presenting wagering game results and other information (e.g., credits, progressive jackpots, etc.). The mobile wagering game machine 800 can also present audio through the audio jack 808 or through a wireless link such as Bluetooth.

In some embodiments, the wireless communication unit 812 can include infrared wireless communications technology for receiving wagering game content while docked in a wager gaming station. The wireless communication unit 824 can include an 802.11G transceiver for connecting to and exchanging information with wireless access points. The wireless communication unit 824 can include a Bluetooth transceiver for exchanging information with other Bluetooth enabled devices.

In some embodiments, the mobile wagering game machine 800 is constructed from damage resistant materials, such as polymer plastics. Portions of the mobile wagering game machine 800 can be constructed from non-porous plastics which exhibit antimicrobial qualities. Also, the mobile wagering game machine 800 can be liquid resistant for easy cleaning and sanitization.

In some embodiments, the mobile wagering game machine 800 can also include an input/output ("I/O") port 830 for connecting directly to another device, such as to a peripheral device, a secondary mobile machine, etc. Furthermore, any component of the mobile wagering game machine 800 can include hardware, firmware, and/or machine-readable media including instructions for performing the operations described herein.

The described embodiments may be provided as a computer program product, or software, that may include a machine-readable medium having stored thereon instructions, which may be used to program a computer system (or other electronic device(s)) to perform a process according to embodiments(s), whether presently described or not, because every conceivable variation is not enumerated herein. A machine readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. In addition, embodiments may be embodied in an electrical, optical, acoustical or other form of propagated signal (e.g., carrier waves, infrared signals, digital signals, etc.), or wireline, wireless, or other communications medium.

GENERAL

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A computer-implemented method, comprising:

presenting a virtual casino floor in a wagering game system, wherein the virtual casino floor includes a first avatar associated with a first wagering game player account that is logged into the wagering game system and provides access to the virtual casino floor, wherein the virtual casino floor also includes a second avatar and a virtual representation of a wagering game machine within the virtual casino floor, wherein the second avatar is associated with a second wagering game player account that is logged into the wagering game system, wherein the first avatar and the second avatar can move about the virtual casino floor, wherein the virtual casino floor includes a private location and an access object that provides access to the private location, and wherein the access object is selectable via player input for one or more of facilitating receipt of information about activity in the private location and providing access to the private location;

determining that the second avatar is inside the private location, wherein the first wagering game player account is a social contact of the second wagering game player account;

detecting an indication of information to communicate from the first avatar to the second avatar; and communicating the information to the second avatar inside the private location of the virtual casino floor.

2. The computer-implemented method of claim 1, further comprising:

determining selection of the virtual representation of the wagering game machine by the first avatar;

generating, in response to the selection, a virtual waiting list indicating a list of avatars waiting to play a wagering game on the virtual representation of the wagering game machine; and placing a representation of the first avatar on the waiting list.

3. The computer-implemented method of claim 1 further comprising:

detecting wagering game activity performed by the first avatar via the virtual representation of the wagering game machine;

generating a sound of the wagering game activity;

detecting a distance between the virtual representation of the wagering game machine and the second avatar within the virtual casino floor:

modifying a volume for the sound according to the distance between the virtual representation of the wagering game machine and the second avatar; and presenting the sound from the perspective of the second avatar as a background effect.

4. The computer-implemented method of claim 2, further comprising:

detecting an additional selection, by the second avatar, of the virtual representation of the wagering game machine; and presenting to the second avatar, in response to the additional selection, a wagering game played on the virtual representation of the wagering game machine by the first avatar.

5. The computer-implemented method of claim 1, wherein the information to communicate from the first avatar to the second avatar comprises a file that includes a recording of gaming activity performed by the first avatar during a gaming session, and wherein communicating the information to the second avatar within the virtual casino floor comprises presenting the file to the second avatar to view the gaming activity.

6. A computer-implemented method comprising:

presenting, on a display device of a wagering game machine, an access object that provides access for avatars to a private location within a virtual casino floor, wherein the avatars can move about the virtual casino floor;

determining a selection of the access object by a first of the avatars via player input, wherein the first of the avatars is located outside of the private location, wherein the first of the avatars is associated with a wagering game player account logged in to the virtual casino floor, and wherein the wagering game player account lists one or more social contacts that belong to the wagering game player account;

determining that a second of the avatars is inside the private location, wherein the second of the avatars belongs to one of the one or more social contacts; and presenting, on the display device of the wagering game machine, to the first of the avatars, information indicating activity of the second avatar within the private location in response to the selection of the access object by the first of the avatars via the player input.

7. The computer-implemented method of claim 6, further comprising:

determining a social status for the wagering game player account;

determining that a level of the social status is insufficient to grant the first of the avatars access to the private location;

detecting access to an advertisement by the first of the avatars associated with the wagering game player account; and granting the first of the avatars access to the private location based on the access to the advertisement by the first of the avatars.

8. The computer-implemented method of claim 6, further comprising:

providing communications between the first of the avatars to the second of the avatars within the private location.

9. The computer-implemented method of claim 6 further comprising:

determining that the wagering game player account possesses a level of social status sufficient to gain access to the private location;

granting access to the private location to the first of the avatars based on the level of the social status; and granting the first of the avatars an avatar power for accessing the private location based on the level of the social status, wherein the avatar power extends beyond the private location to additional locations in the virtual representation of the wagering game venue.

10. The computer-implemented method of claim 9, wherein the determining the that the wagering game player account possesses the level of social status sufficient to gain access to the private location comprises one or more of determining a value of social network points that the wagering game player account owns, and determining an award that the wagering game player account has received that indicates an increase to the level of the social status for a momentary amount of time.

11. One or more non-transitory computer readable mediums including instructions that, when executed by one or more machines, cause the computers to perform operations comprising:

presenting a virtual casino floor in a wagering game system, wherein the virtual casino floor includes a first avatar associated with a first wagering game player account that is logged into the wagering game system and provides access to the virtual casino floor, wherein the virtual casino floor also includes a second avatar and a virtual representation of a wagering game machine within the virtual casino floor, wherein the second avatar is associated with a second wagering game player account that is logged into the wagering game system, wherein the first avatar and the second avatar can move about the virtual casino floor, wherein the virtual casino floor includes a private location and an access object that provides access to the private location, and wherein the access object is selectable via player input for one or more of facilitating receipt of information about activity in the private location and providing access to the private location;

determining that the second avatar is inside the private location, wherein the first wagering game player account is a social contact of the second wagering game player account;

detecting an indication of information to communicate from the first avatar to the second avatar; and communicating the information to the second avatar inside the private location of the virtual casino floor.

12. The one or more non-transitory computer readable mediums of claim 11, further comprising:

determining selection of the virtual representation of the wagering game machine by the first avatar;

generating, in response to the selection, a virtual waiting list indicating a list of avatars waiting to play a wagering game on the virtual representation of the wagering game machine; and placing a representation of the first avatar on the waiting list.

13. The one or more non-transitory computer readable mediums of claim 11, the operations further comprising:

detecting wagering game activity performed by the first avatar via the virtual representation of the wagering game machine;

generating a sound of the wagering game activity;

detecting a distance between the virtual representation of the wagering game machine and the second avatar within the virtual casino floor;

modifying a volume for the sound according to the distance between the virtual representation of the wagering game machine and the second avatar; and presenting the sound from the perspective of the second avatar as a background effect.

14. The one or more non-transitory computer readable mediums of claim 12, the operations further comprising:

detecting an additional selection, by the second avatar, of the virtual representation of the wagering game machine; and presenting to the second avatar, in response to the additional selection, a wagering game played on the virtual representation of the wagering game machine by the first avatar.

15. The one or more non-transitory computer readable mediums of claim 11, wherein the information to communicate from the first avatar to the second avatar comprises a file that includes a recording of gaming activity performed by the first avatar during a gaming session, and wherein communicating the information to the second avatar within the virtual casino floor comprises presenting the file to the second avatar to view the gaming activity.

16. The one or more non-transitory computer-readable mediums of claim 11, the operations further comprising:

determining a social status for the first wagering game player account;

determining that the social status for the first wagering game player account is sufficient to gain access to the private location; and granting the first wagering game player account an avatar power for accessing the private location.

17. The method of claim 1, further comprising:

determining a social status for the first wagering game player account;

determining that the social status for the first wagering game player account is sufficient to gain access to the private location; and granting the first wagering game player account an avatar power for accessing the private location.

* * * * *